US011723495B2

(12) United States Patent
Lewis et al.

(10) Patent No.: US 11,723,495 B2
(45) Date of Patent: Aug. 15, 2023

(54) ROLLED PRODUCT FEED SYSTEM

(71) Applicant: Kimberly-Clark Worldwide, Inc., Neenah, WI (US)

(72) Inventors: Richard P. Lewis, Marietta, GA (US); I-Chung Hou, Hsinchu (TW); Wan-Chih Lin, Hsin-Chu (TW); Ming-Chung Chung, Hsinchu County (TW); Chih-An Chen, Zhubei (TW); Wan-Chang Liang, Toufen (TW); Chan-Hao Chen, Jhubei (TW); Huang-Keng Chen, Jhubei (TW); Ching-Lung Mao, Taipei (TW); Wei-Ming Huang, Taipei (TW)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 120 days.

(21) Appl. No.: 17/600,041

(22) PCT Filed: Mar. 29, 2019

(86) PCT No.: PCT/US2019/025030
§ 371 (c)(1),
(2) Date: Sep. 29, 2021

(87) PCT Pub. No.: WO2020/204897
PCT Pub. Date: Oct. 8, 2020

(65) Prior Publication Data

US 2022/0192439 A1 Jun. 23, 2022

(51) Int. Cl.
*A47K 10/36* (2006.01)
*A47K 10/38* (2006.01)
*B65H 16/00* (2006.01)

(52) U.S. Cl.
CPC ..... *A47K 10/36* (2013.01); *A47K 10/38* (2013.01); *B65H 16/005* (2013.01);
(Continued)

(58) Field of Classification Search
CPC ..... A47K 10/36; A47K 10/38; A47K 2010/3668; A47K 2010/3681;
(Continued)

(56) References Cited

U.S. PATENT DOCUMENTS 1,746,582 A 2/1930 Elder
2,560,061 A 7/1951 Agamaite, Jr.
(Continued)

FOREIGN PATENT DOCUMENTS

CN 2339143 Y 9/1999
CN 102099263 A 6/2011
(Continued)

OTHER PUBLICATIONS

American Specialties, Inc., "Automatic Roll Towel Dispenser Mechanism", https://americanspecialties.com/wp-content/uploads/8374.pdf.

*Primary Examiner* — William A. Rivera

(57) ABSTRACT

Systems, methods and apparatus for dispensing of paper products. A dispenser comprising a housing comprising a product holding area defined by a front, back and two sides, and a dispenser throat defining an opening through the housing; a motor coupled to the rolled product and configured to rotate the rolled product in first and second directions; and a feed mechanism having a first side opening and a second side opening different from the first side opening, wherein both the first side and second side openings are different from that dispenser throat, and wherein the first side opening is configured to accept the tail when the rolled product has a first orientation and is rotated in the first direction and the second side opening is configured to accept the tail when the rolled product has a second orientation and is rotated in the second direction.

18 Claims, 7 Drawing Sheets

(52) U.S. Cl.
CPC ..... *A47K 2010/3668* (2013.01); *A47K 2010/3681* (2013.01); *B65H 2301/41509* (2013.01); *B65H 2301/4431* (2013.01); *B65H 2402/43* (2013.01); *B65H 2402/442* (2013.01); *B65H 2407/20* (2013.01); *B65H 2513/412* (2013.01)

(58) Field of Classification Search
CPC ..... A47K 10/3612; A47K 10/3625; A47K 10/3827; B65H 16/005; B65H 2301/41509; B65H 2301/4431; B65H 2402/43; B65H 2402/442; B65H 2407/20; B65H 2513/412
See application file for complete search history.

(56) References Cited

U.S. PATENT DOCUMENTS

| | | | | | |
|---|---|---|---|---|---|
| 3,288,387 | A | | 11/1966 | Craven, Jr. | |
| 4,406,421 | A | * | 9/1983 | Schultz | A47K 10/36 226/129 |
| 5,107,734 | A | * | 4/1992 | Armbruster | A47K 10/3612 83/205 |
| 5,601,253 | A | * | 2/1997 | Formon | A47K 10/3827 242/595.1 |
| 5,908,137 | A | * | 6/1999 | Pattarozzi | A47K 10/3643 221/45 |
| 6,079,305 | A | | 6/2000 | Bloch et al. | |
| 6,161,795 | A | | 12/2000 | Skerrett et al. | |
| 9,907,441 | B2 | | 3/2018 | Osborne, Jr. et al. | |
| 2005/0275153 | A1 | | 12/2005 | Owa | |
| 2008/0245922 | A1 | | 10/2008 | Fellhoelter | |
| 2012/0193387 | A1 | | 8/2012 | Dick et al. | |
| 2013/0161346 | A1 | * | 6/2013 | Wolme | A47K 10/38 242/562 |
| 2013/0334357 | A1 | | 12/2013 | Huruse | |
| 2017/0290471 | A1 | * | 10/2017 | Borke | A47K 10/3656 |
| 2019/0380546 | A1 | * | 12/2019 | Sexton | A47K 10/3687 |
| 2020/0163498 | A1 | * | 5/2020 | Osborne, Jr. | A47K 10/3687 |

FOREIGN PATENT DOCUMENTS

| | | | | |
|---|---|---|---|---|
| CN | 107049115 | A | | 8/2017 |
| CN | 107212794 | A | | 9/2017 |
| CN | 207654088 | U | | 7/2018 |
| JP | 2004-505743 | | * | 2/2004 |

* cited by examiner

ROLLED PRODUCT FEED SYSTEM

This disclosure generally relates to a consumable product dispensing system.

BACKGROUND

Systems dispensing consumable products are common in many environments today. For example, consumable product dispensers, e.g., paper hand towel dispensers, are used in many private, semi-private and public washrooms, break rooms, kitchens and work spaces. Given this widespread adoption, it's desirable to ensure the dispensers are easy to load with product to reduce maintenance overhead/burden and ensure smooth operation after the loading process.

SUMMARY

In general, the subject matter of this specification relates to a paper product dispenser for rolled products such as rolled hand towels. One aspect of the subject matter described in this specification can be implemented in systems that include a paper product dispenser comprising a housing comprising a front, a back, two sides, a product holding area defined by the front, back and two sides, and a dispenser throat defining an opening through the housing; a support device configured to support a rolled product in the product holding area, wherein the rolled product has a tail; a motor operatively coupled to the rolled product and configured to rotate the rolled product in at least one of a first direction and a second direction; and a feed mechanism having a first side opening and a second side opening different from the first side opening, wherein both the first side opening and the second side opening are different from the dispenser throat, and wherein the first side opening is configured to accept the tail of the rolled product when the rolled product has a first orientation and is rotated in the first direction and the second side opening is configured to accept the tail of the product when the rolled product has a second orientation and is rotated in the second direction. Other embodiments of this aspect include corresponding apparatus and methods.

Yet another aspect of the subject matter described in this specification can be implemented in a method including rotating a rolled product to feed a tail of the rolled product into a feed mechanism having a first side opening and a second side opening different from the first side opening, wherein the first side opening is configured to accept the tail of the rolled product when the rolled product has a first orientation and rotated in the first direction and the second side opening is configured to accept the tail of the product when the rolled product has a second orientation and is rotated in the second direction. Other embodiments of this aspect include corresponding apparatus and systems.

Particular embodiments of the subject matter described in this specification can be implemented so as to realize one or more of the following advantages. Traditional loading of a paper towel roll or bath tissue roll into a respective electronic dispenser required threading the tail of the roll through a set or series of rollers. This threading often required the service attendant to push the tail into rollers and then advance the tail through the rollers (e.g., through actuation of the dispenser motor) and out through the dispenser throat for user access. If the tail was not evenly threaded into the rollers the skewed tail may prematurely tear when advanced by the motor or cause jams during the dispensing process. Further, for such traditional dispensers, other dispensing errors can occur if the roll is loaded into the dispenser backwards, e.g., the roll is loaded in the dispenser to unwind counterclockwise when the dispenser is configured to unwind the roll in a clockwise direction or vis-a-versa.

The feed mechanism described herein reduces the likelihood that a roll tail is feed into the dispenser askew as it automates the tail feeding process to eliminate service attendant feeding errors while simultaneously saving the attendants' time as they no longer need to perform this step. Further, the feed mechanism can accommodate the roll loaded for either the clockwise or counterclockwise unwinding configuration, which avoids problems stemming from a roll being loaded in the wrong configuration in traditional dispensers.

The details of one or more implementations of the subject matter described in this specification are set forth in the accompanying drawings and the description below. Other features, aspects, and advantages of the subject matter will become apparent from the description, the drawings, and the claims.

DESCRIPTION OF DRAWINGS

Like reference symbols in the various drawings indicate like elements.

DETAILED DESCRIPTION

Figure 1:
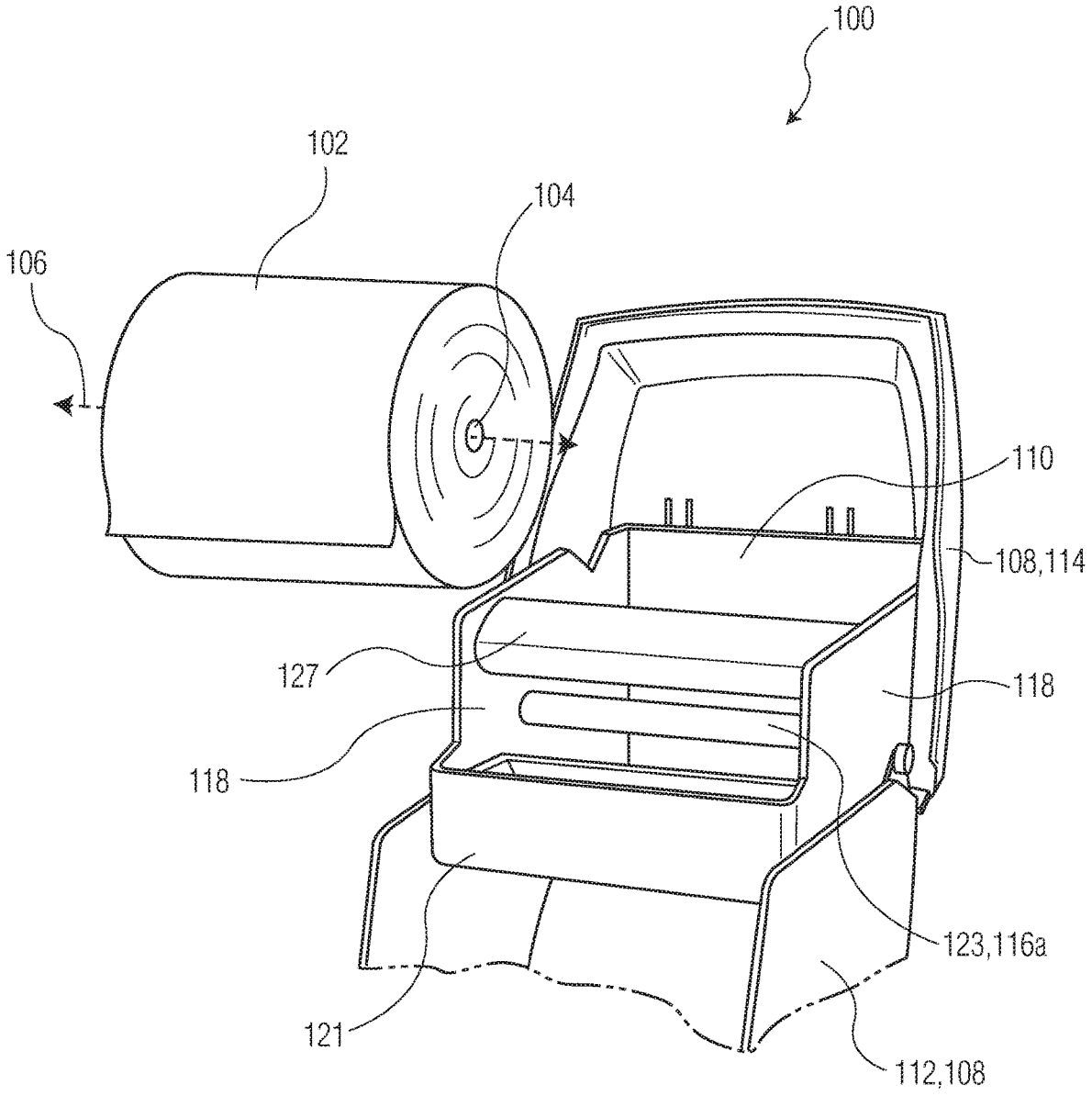
FIG. 1 is a representation of an example paper product dispenser.

The present disclosure generally relates to a rolled paper product dispenser that includes an automatic roll (tail) feeding mechanism.

In some implementations, the dispenser includes a feed mechanism that is biased against the periphery of an installed roll. The feed mechanism has a first side opening and a second side opening. The first side opening can accept a tail of the roll when the roll is installed and unwound in a first direction (e.g., unwound in a clockwise direction) and the second side opening can accept the tail when the roll is installed and unwound in a second direction (e.g., unwound in a counterclockwise direction).

In operation, after the roll has been installed, a motor in the dispenser will rotate the roll and the feed mechanism will pick the tail off the periphery of the rotating roll, regardless of whether the roll is rotating in a clockwise or counterclockwise direction, and facilitate feeding the tail towards the discharge path (e.g., exit of the dispenser) for access by a user. The dispenser is described in more detail below with reference to FIG. 1, which is a representation of an example product dispenser 100, FIG. 2, which is a representation of an example product dispenser 100 with rolled product 102, and FIG. 3, which is a side view of a representation of a cutaway of an example dispenser 100.

The dispenser 100 can be, for example, a hand towel dispenser 100, or the like, e.g., bath tissue or wipes/wipers, for rolled paper products 102. A paper product describes sheet materials made from cellulose fibers (e.g., wood pulp), synthetic fibers (e.g., polypropylene) or some combination thereof, and include, for example, bath tissue, paper towels and wipes/wipers including made from woven and nowoven technologies. A rolled product is a product that is wound around a core 104 or center axis 106, e.g., the axis around which the paper product 102 is wound.

Figure 2:
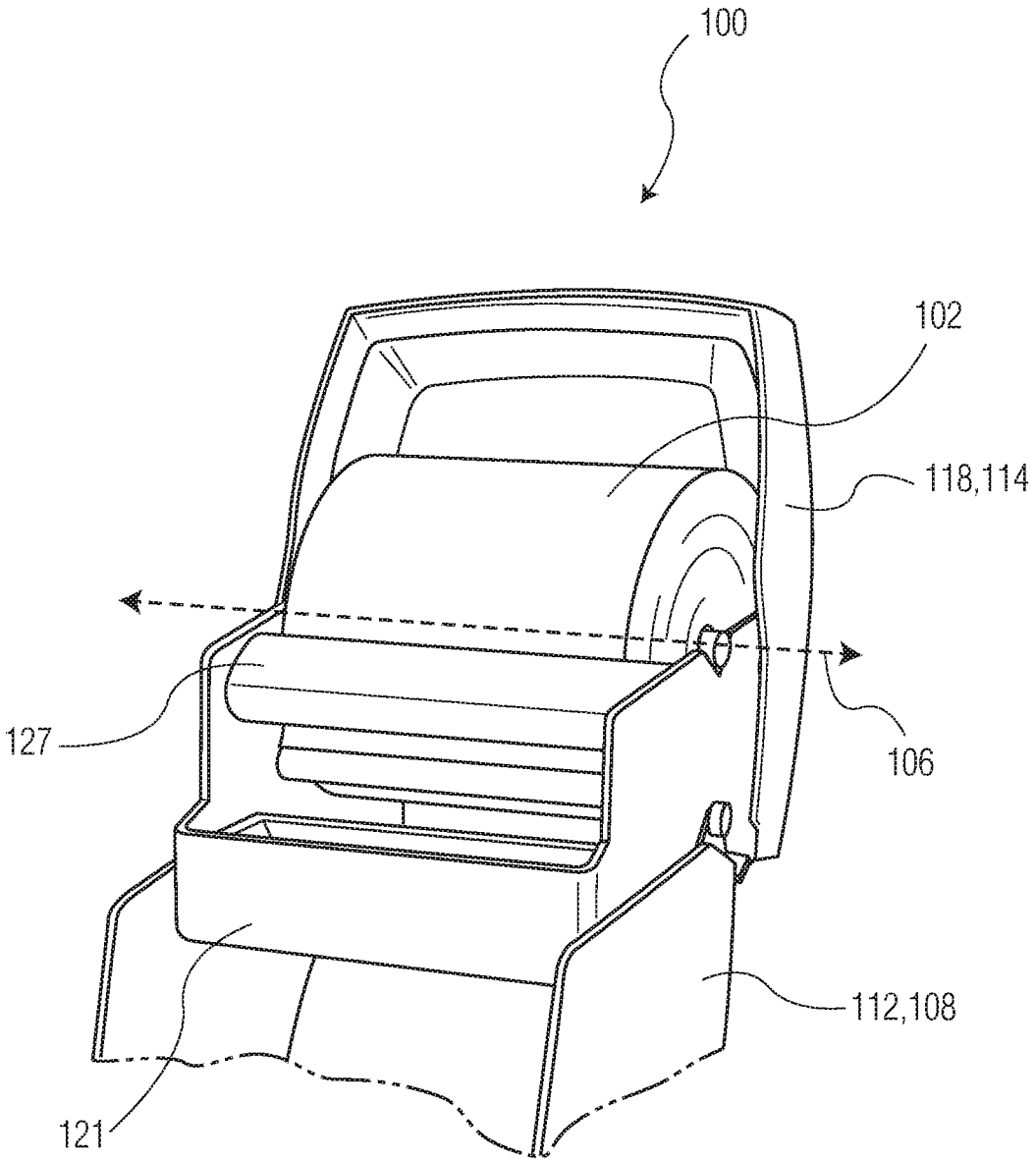
FIG. 2 is a representation of an example paper product dispenser with paper product.

The dispenser 100 includes a body or housing 108, e.g., a composite or metal housing, with an outer surface, e.g., an exterior surface of the body 108. The dispenser 100 also includes a product holding area 110 to hold the rolled product 102. As shown in FIG. 1, the dispenser 100 is illustrated with the front cover 112 of the body 108 opened to show the product holding area 110.

The product holding area 110 is a space or cavity within the body 108 in which the product 102 can be positioned for dispensing, and can be accessed, for example, by rotating the front cover 112 (only partially shown in the figures) away from the back cover 114 (e.g., the wall mounted portion) by a hinge or the like. In some implementations, the front cover 112 or the front surface of the front cover 112 can be attached to the remainder of the dispenser body 108, for example, through magnetic forces (e.g., magnetics on/in the front cover 112) a friction or mechanical interference fit such as detents, or tracks or slots to slide the front cover 112 on or off.

The body 108 includes a dispenser throat 119 defining an opening through the body 108. The dispenser throat 119 provides an outlet through which dispensed paper 102*a* can exit the dispenser 100 for use by a user. In some implementations, the dispenser throat 119 is located proximate the bottom side of the dispenser 100.

Figure 3:
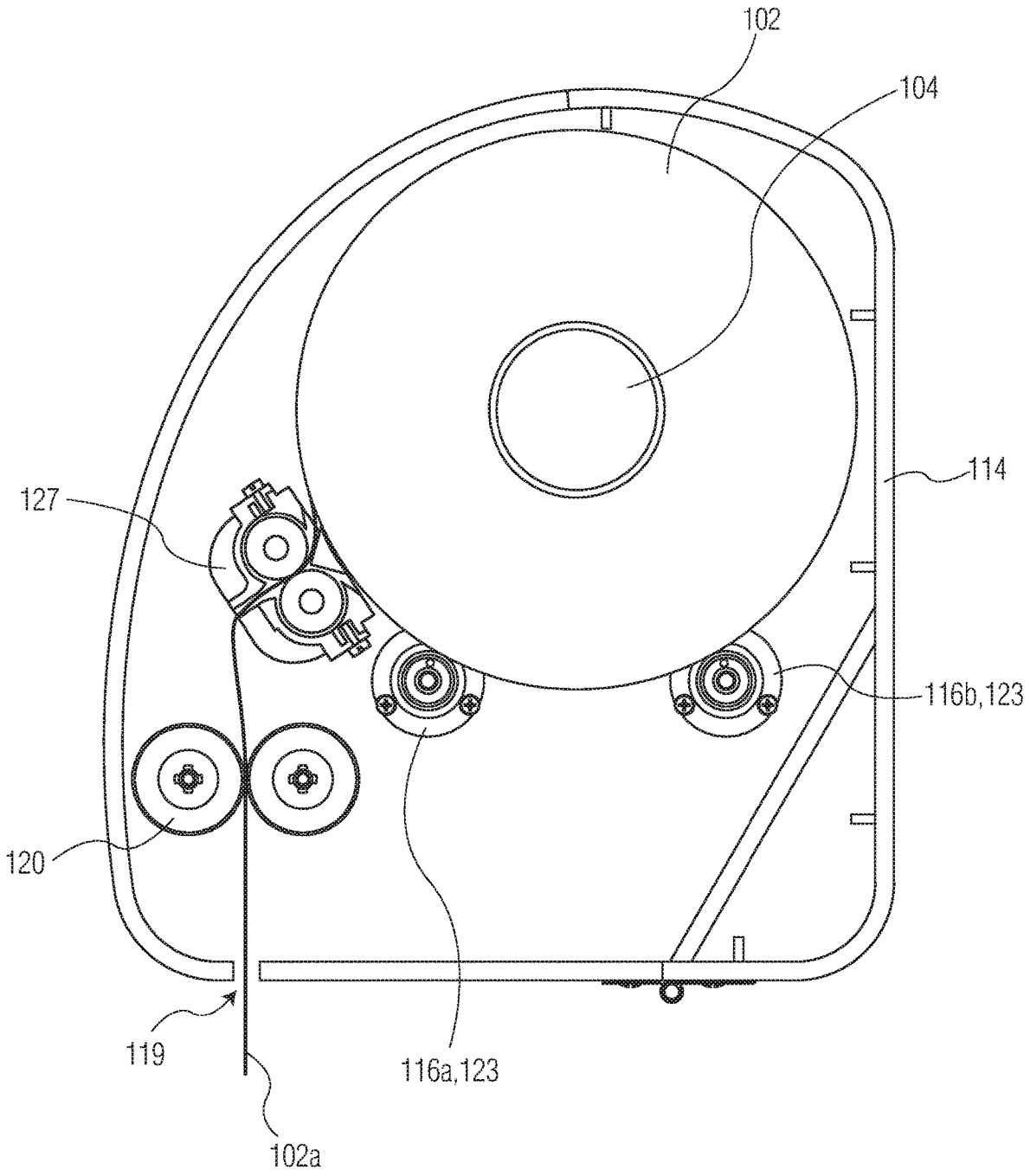
FIG. 3 is a side view of a representation of a cutaway of an example dispenser.

The dispenser 100 includes a support device 123 to support the rolled product 102 in the product holding area 110. In some implementations, support device 123 includes a first spindle arm 116*a* (e.g., close to the front cover 112 when closed) and a second spindle arm 116*b* (e.g., close to the back cover 114) in the product holding area 110. In combination, the first and second spindles 116*a, b* are used to hold the rolled product (also referred to as the roll) 102 along its periphery, as shown in FIG. 3 and rotate to facilitate unwinding the roll 102 for dispensing to a user. The spindle arms 116*a, b* are positioned between the dispenser sides 118 e.g., on arms proximate or attached to the sides 118. Each spindle arm 116*a, b*, in some implementations, includes a roller or other rotation member that rotates along with (or drives) the unwinding of the roll 102. In some implementations, the spindle arms 116*a, b* do not rotate. In this case, for example, the rolled product 102 can rotate in place (held and supported by the spindle arms 116*a, b*) in response to a user pull on an exposed portion (e.g., tail 102*a*) of the product 102.

The spaced relation of the spindle arms 116*a, b*, in some implementations, is substantially parallel to each other in the horizontal plane, e.g., both are in or near the horizontal plane. But, more generally, as used herein, spaced relation means that the two spindle arms 116*a, b* are positioned relative to each other to allow a roll 102 to rest on them and not fall off from gravity, and placed no further apart than the diameter of the roll 102. In some implementations, other support devices can additionally or alternatively be used to support and/or hold the roll 102, as described below.

In some implementations, the support device 123, e.g., instead of the spindle arms 116*a, b*, includes a core support mechanism (not pictured). The core support mechanism can be a core spindle (or rod) that extends through the core 104 generally along the center axis 106 and is supported on both the left and right side of the dispenser 100 (e.g., on cradles affixed to the sides 118 of the dispenser 100). In these implementations, the core support mechanism is removable to allow it to be inserted into the core 104 of the roll 102 and then placed, for example, in the cradles. In these implementations either or both the core support mechanism and the roll 102 can rotate.

In some implementations, the support device 123 includes support arms that extend from either side (e.g., sides 118) of the dispenser 100 and engage the core 104 of the roll 102 on each respective side to hold the roll 102 in the product holding area 110. For example, the arms include nubs or other extensions that at least partially insert (e.g., project) into the core 104 on either side of the roll 102 to hold it. The arms are semi-rigid such that they can be flexed apart to allow the roll 102 to be placed in between and then released to "pinch" the roll and rotatably hold the roll 102.

The dispenser 100 includes a motor (not pictured). The motor is coupled to the rolled product 102 and operates to rotate the rolled product 102 in at least one of a first direction (e.g., clockwise) or a second direction (e.g., counterclockwise). The motor can be coupled to the roll 102, for example, through the first and second spindle arms 116*a, b* or the core support mechanism (or through roller pair 120, 122, as described below). In such implementations the motor turns the spindle arms 116*a, b* (one or both), core support mechanism, or one or both rollers 120, 122, (e.g., through gears, belts, or another type of transmission or direct coupling) to rotate (e.g., unwind) the roll 102.

In some implementations, the dispenser 100 includes a proximity sensor (e.g., IR sensor) that detects a user movement, for example, in front of the dispenser 100 or in the vicinity of the throat 119, to indicate a user requesting a dispense. Upon such detection, for example, the motor actuates and causes the roll 102 to unwind and advance a portion of the roll 102 through the throat 119 to the user.

The dispenser 100 includes a feed mechanism 127. The feed mechanism gathers the tail of the roll 102 to properly feed it into the dispenser 102 for dispensing (e.g., as would be required when a new roll 102 is inserted into the dispenser 100 or after the dispenser 100 has been serviced and a partially depleted roll 102 needs to be re-inserted into the dispenser 100). Generally, the tail 102*a* of the roll 102 refers to the free end of the roll 102, i.e., the end portion of the roll 102 available to be unwound from the remainder of the roll 102.

Figure 4A:
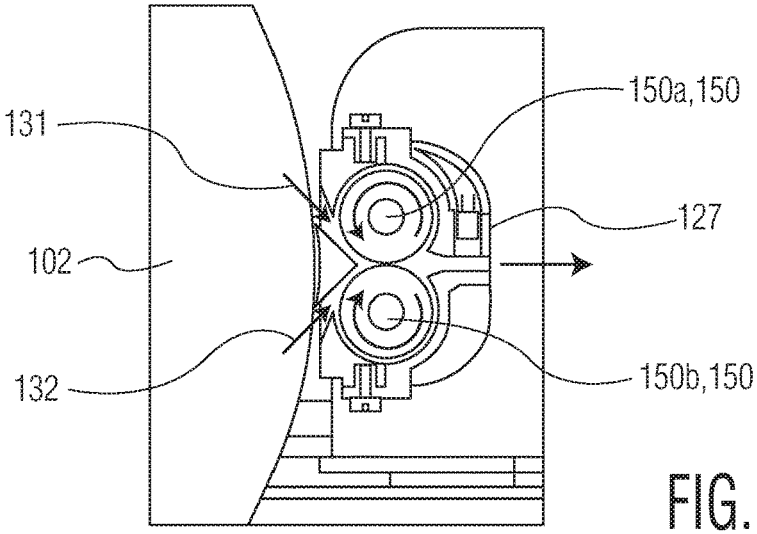
FIGS. 4A-4C are side views of a representation of a cutaway of an example feed mechanism.
Figure 4B:
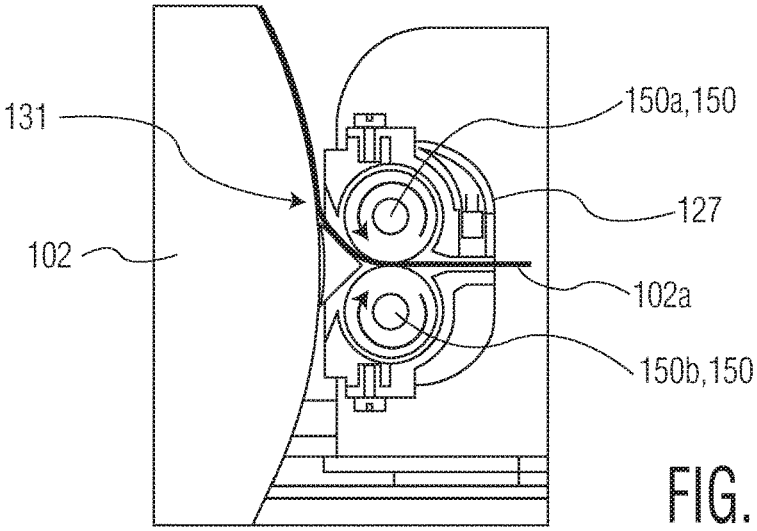
Figure 4C:
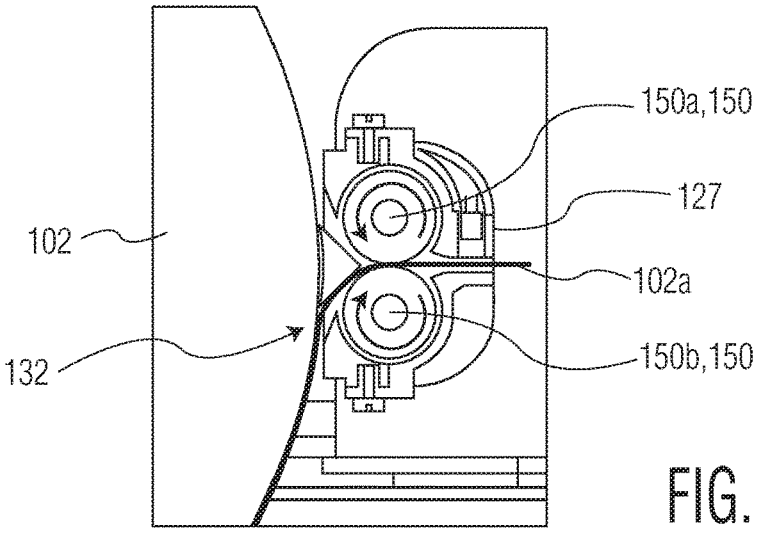

The feed mechanism 127 has a first side opening 131 and a second side opening 132 different from the first side opening 131, as shown in FIGS. 4A-4C, which are side views of a representation of a cutaway of an example feed mechanism 127. Both the first side opening 131 and the second side opening 132 are different from that dispenser throat 119. In some implementations, the feed mechanism 127, for example, spans the width of the roll 102 and/or dispenser (e.g., from side-to-side 118 of the dispenser body 108). In other implementations, the feed mechanism is only partially spans the width of the roll 102. The feed mechanism 127 can be supported, for example, by support structures attached to (i) one or both sides 118, (ii) the inside of the front cover 112 such that when the front cover 112 is closed the feed mechanism 127 is pressed against the roll 102 or (ii) the front lower support 121.

Regardless of the particular support system, the feed mechanism 127 is positioned against the periphery of roll 102 when in use. For example, the feed mechanism 127 is positioned to engage the periphery portion of the roll 102 proximate: the front cover 112 when closed, the front lower support 121, the bottom or top of the roll 102, or the portion of the roll 102 proximate the back cover 114.

In operation, the first side opening 131 accepts the tail 102*a* of the rolled product 102 when the rolled product 102 has a first orientation and is rotated in the first direction. For example, the first side opening 131 accepts the tail 102*a* when the roll 102 is unwound in a clockwise direction (i.e., the first direction when in the first orientation). And the second side opening 132 accepts the tail 102*a* of the rolled product 102 when the rolled product 102 has a second orientation and is rotated in the second direction. For example, the second side opening 132 accepts the tail 102*a* when the roll 102 is unwound in a counterclockwise direction (i.e., the second direction when in the second orientation). The particular orientation of the roll 102 is set by the design of a given dispenser 102, but in either orientation and unwind direction, the feed mechanism 127 can grab the tail 102*a* as the roll 102 is rotated, e.g., through an actuation of the motor(s). Generally, roll orientation refers to the tail 102*a* pointing in the direction of roll 102 rotation/direction.

Figure 5:
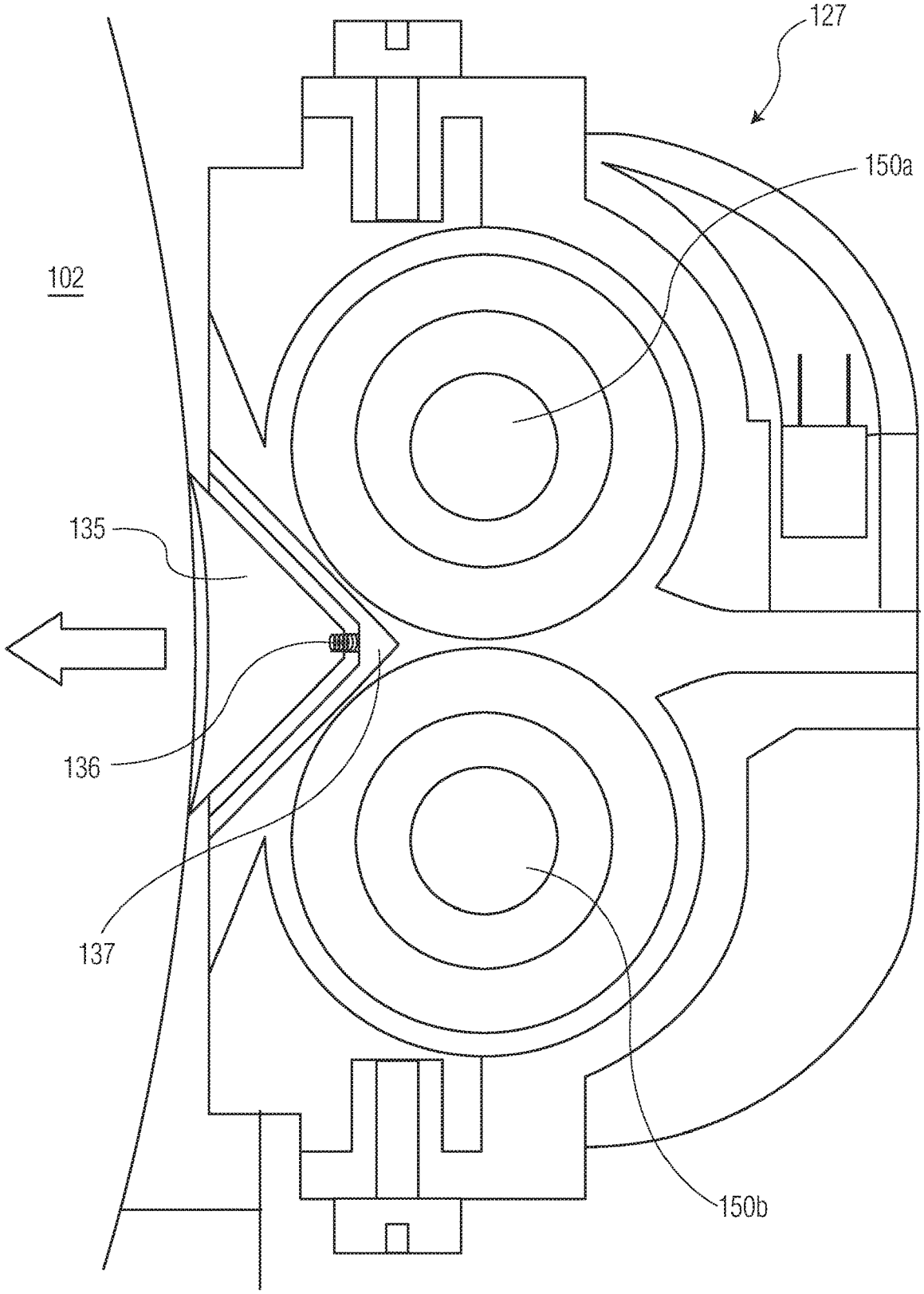
FIG. 5 is an expanded view of a representation of a cutaway of an example feed mechanism.

To encourage the tail 102*a* to route into one of the first or second side openings 131, 132 as the roll 102 rotates, the feed mechanism 127, in some implementations, includes a feed head 135 slidably attached to a feed mechanism body 137, as shown in FIG. 5, which is an expanded view of a representation of a cutaway of an example feed mechanism 127. In some implementations, the feed head 135 is movably attached to the feed mechanism body 137 through a biasing device 136, such as, for example, a spring 136, to bias the feed head 135 against the surface periphery of the roll 102. Relative to the feed head 135, the feed mechanism body 137 is stationary. As such, when the tail 102*a* encounters the feed head 136 the tail 102*a* is picked up from the surface of the roll 102 and directed into the appropriate first or second side opening 131, 132. For example, FIG. 4B shows the tail 102*a* being directed into the first side opening 131 and FIG. 4C shows the tail 102*a* being directed into the second side opening 132. Initially, the tail 102*a* is pushed into and at least partially through the appropriate opening 131, 132 by the force from the rotating roll 102.

In some implementations, the feed mechanism 127 includes a feed puller 150, e.g., an electromechanical device, having two opposing feed rollers 150*a, b*. The opposing feed rollers 150*a, b* rotate in coordination (e.g., by pinching the tail 102*a* between the feed rollers 150*a, b*) to pull the tail 120*a* through the appropriate first or second side opening 131, 132. More particularly, the rotational force of the roll 102 pushes the tail 102*a* to the opposing feed rollers 150*a, b* and then the opposing feed rollers 150*a, b* provide the force (or additional force) to direct the tail along the discharge path to the throat 119. The opposing feed rollers 150*a, b* can be, for example, actuated in concert with the motor such that when (e.g., and as long as) the motor actuates the opposing feed rollers 150*a, b* also actuate (e.g., rotate). This actuation causes the feed roller 150*a* to turn in a counterclockwise direction and feed roller 150*b* to turn in a clockwise direction.

To prevent, for example, the tail 102*a* bunching up in the openings 131, 132, the feed puller 150 (e.g., opposing feed rollers 150*a, b*) rotate(s) at a first rate, the motor rotates the rolled product 102 at a second rate, and the first rate is greater than the second rate. For example, the rate (e.g., length per unit time) at which the paper 102 is pulled by the opposing feed rollers 150*a, b* is five (or ten) percent faster than the rate (e.g., length per unit time) of the rolled product 102 being unwound by the motor. For example, the roll 102 can be rotated at a rate of 1.0 inch/second and the feed mechanism 127 cause the feed rollers 150*a, b* to rotate at a rate of 1.1 inch/second. This differential helps to mitigate any bunching and jam issues through the feed mechanism 127. More generally, the selected differential may depend on multiple factors including the strength of the paper product of roll 102. The differential can be selected to overdrive the opposing feed rollers 150*a, b* as compared to the roll 102 so that the opposing feed rollers 150*a, b* put tension on paper product of the roll 102 while not providing so much strain to break or prematurely tear the paper product. In some implementations, separate motors are used to actuate the feed puller 150 and rotate the roll 102. In other implementations, the same motor can be used to actuate the feed puller 150 and rotate the roll 102.

Figure 6:
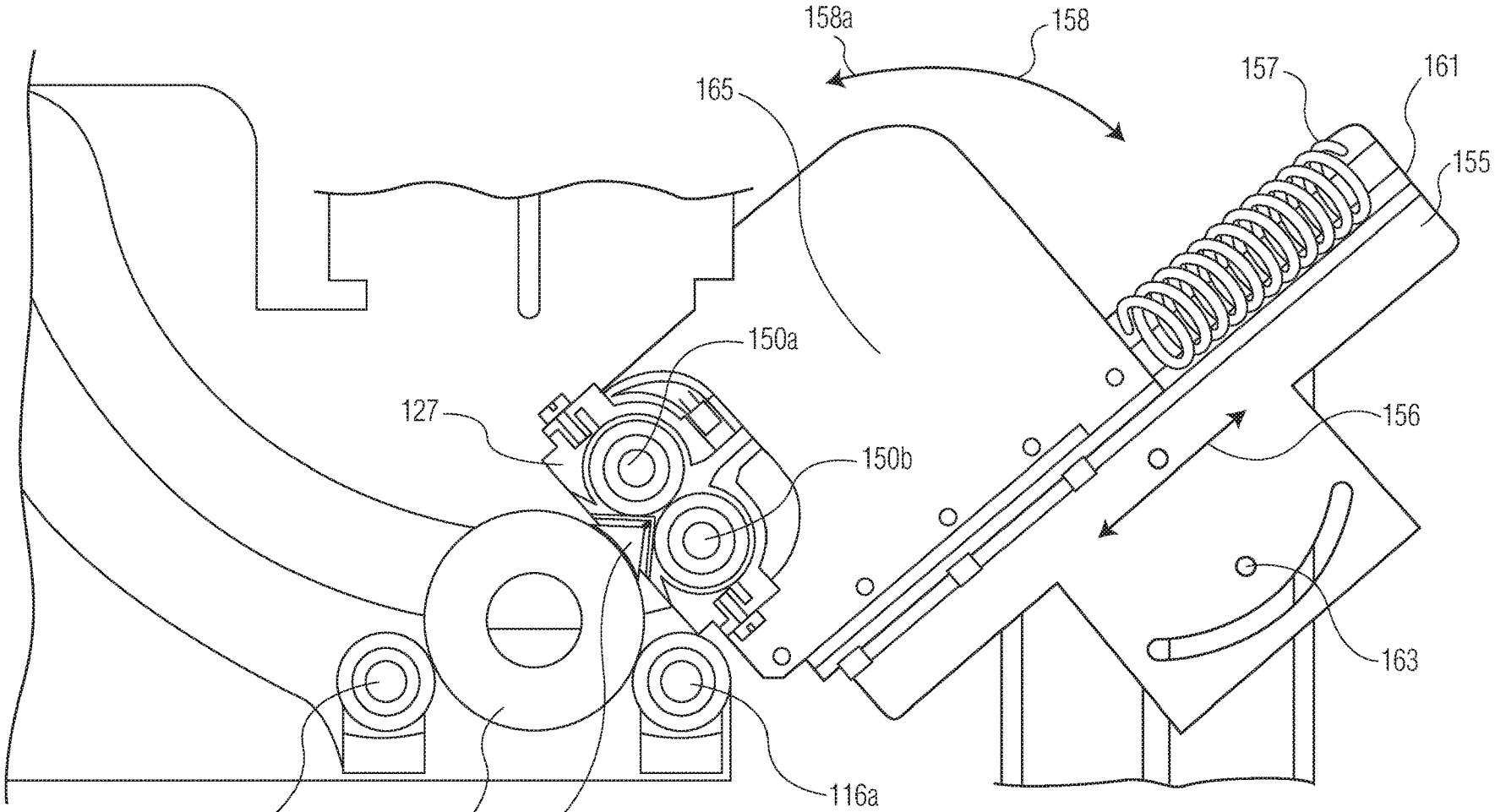
FIG. 6 is a side view of a representation of a cutaway of another example feed mechanism.

In some implementations, in addition to or alternative to the a slideable feed head 135, the dispenser 100 includes a track 155 along which the feed mechanism 127 can slide and/or pivot, as shown in FIG. 6, which is a side view of a representation of a cutaway of another example feed mechanism 127. For example, the feed mechanism 127 can slide back and forth along the track 155 parallel to axis 156.

In some implementations, the feed mechanism 127 is biased against a periphery of the roll 102 as the roll's diameter decreases during depletion of the roll 102. For example, the feed mechanism 127 is biased along the track 155 by a biasing member (e.g., a spring) 157 to keep the feed mechanism 127 pushed up against the roll 102 as the roll's diameter shrinks as the roll 102 depletes. This allows the feed mechanism 127 to always be positioned to pick up a tail 120*a* for different size (e.g., diameter rolls 102) Conversely, when a new roll 102 is inserted, the feed mechanism 127 can slide back towards end 161 to accommodate the new (or different), larger diameter roll (as compared to the depleted roll). Further, the track 155, including the feed mechanism 127, can pivot (around point 163) along arc 158. In some implementations, the weight of the head 165 of the track 155 (or another biasing member) biases the track 155 to pivot towards (and against) the roll 102. In this way the adjustment available through the pivot 163 and the track 155 encourages the feed mechanism 127 to engage the roll 102, whether the roll 102 has a large or small diameter.

Figure 7:
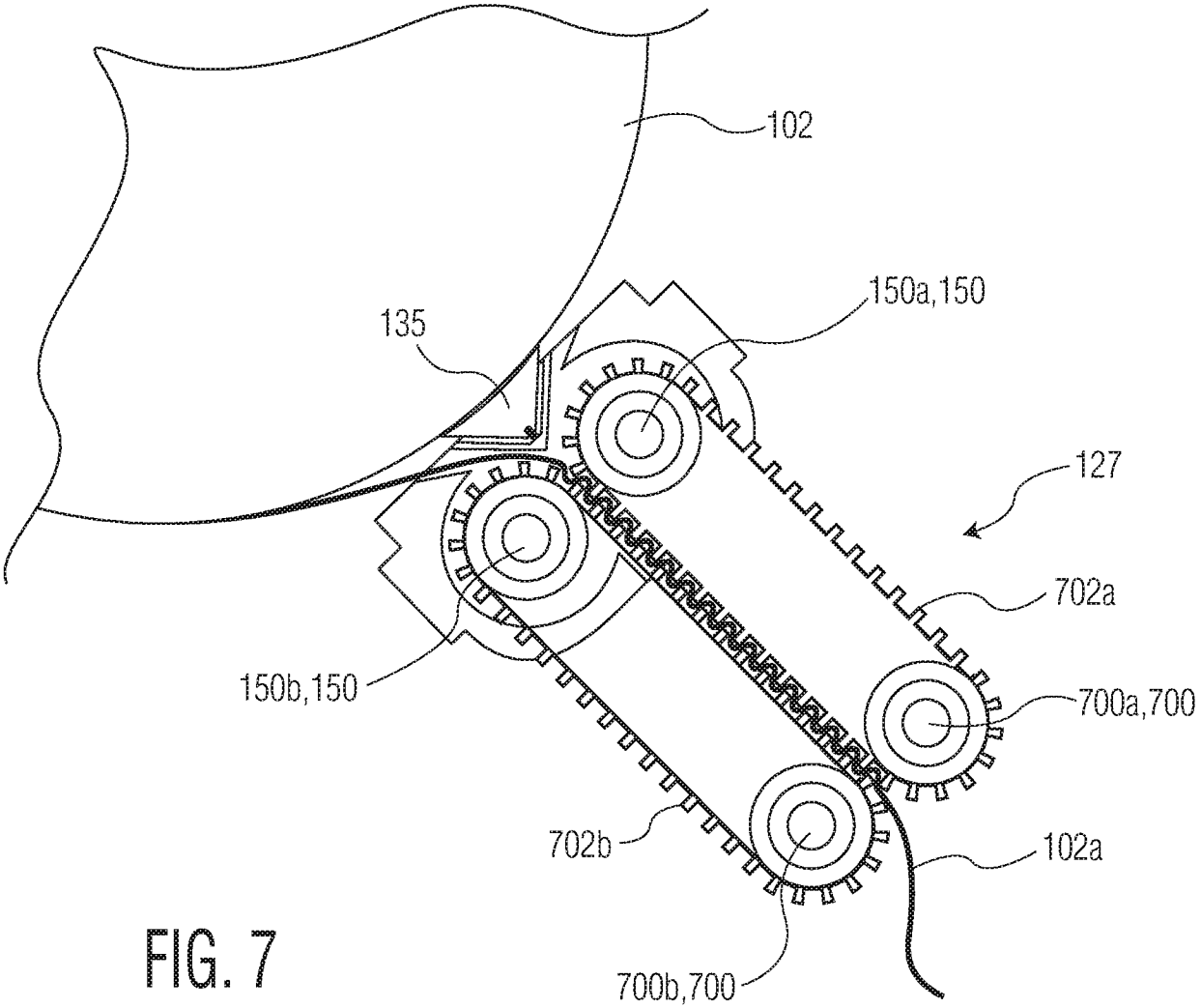
FIG. 7 is a side view of a representation of a cutaway of yet another example feed mechanism.

In some implementations, the feed mechanism 127 includes additional rollers 700*a* and 700*b* connected to rollers 150*a* and 150*b*, respectively, through pliable connectors such as belts 702*a, b* (or the like), as shown in FIG. 7, which is a side view of a representation of a cutaway of yet another example feed mechanism 127. The belts 702*a, b*, for example, may have opposing grooves to better grip the tail 102*a* and pull it through or the belts 702*a, b* could be smooth relying on pressure and/or other friction or adhesives to grip the tail 102*a*. Using the elongated belt system in FIG. 7 may reduce tearing of the roll paper including the tail 102*a* as there is more surface area for the feed mechanism 127 to grip, as compared to the feed mechanism 127 shown in, for example, FIGS. 4A-C.

In some implementations, dispenser 100 includes a roller pair 120, 122. The roller pair 120, 122, like the spindle arms 116*a, b*, can extend across the width of the dispenser 100 and rotate. The roller pair 120, 122 function to accept paper from the feed mechanism 127 and direct it down through the dispenser throat 119 and out to a user. For example, as paper is feed in between the roller pair 120, 122, the roller 120 turns clockwise and the roller 122 turns counterclockwise.

In this way, the roller pair 120, 122 draws/pulls or guides the paper from the roll 102 and distributes it down to the dispenser throat 119.

EMBODIMENTS

Embodiment 1. A paper product dispenser comprising a housing comprising a front, a back, two sides, a product holding area defined by the front, back and two sides, and a dispenser throat defining an opening through the housing; a support device configured to support a rolled product in the product holding area, wherein the rolled product has a tail; a motor operatively coupled to the rolled product and configured to rotate the rolled product in at least one of a first direction and a second direction; and a feed mechanism having a first side opening and a second side opening different from the first side opening, wherein both the first side opening and the second side opening are different from that dispenser throat, and wherein the first side opening is configured to accept the tail of the rolled product when the rolled product has a first orientation and is rotated in the first direction and the second side opening is configured to accept the tail of the product when the rolled product has a second orientation and is rotated in the second direction.

Embodiment 2. The paper product dispenser of embodiment 1, wherein the feed mechanism comprises a feed puller including two opposing feed rollers configured to rotate to pull the tail through at least one of the first and second side openings.

Embodiment 3. The paper product dispenser of embodiment 2, wherein the feed puller rotates at a first rate, the motor rotates the rolled product at a second rate, and the first rate is greater than the second rate.

Embodiment 4. The paper product dispenser of any of the preceding embodiments, wherein the feed mechanism includes a feed head slidably attached to a feed mechanism body.

Embodiment 5. The paper product dispenser of embodiment 4, wherein the feed head is configured to be biased against a periphery of the rolled product.

Embodiment 6. The paper product dispenser of any of the preceding embodiments, wherein the support device comprises a first spindle arm in the product holding area and extending between the two sides, a second spindle arm in the product holding area, extending between the two sides and substantially parallel to the first spindle arm, wherein the first and second spindle arms are configured to hold the rolled product along a periphery of the rolled paper product and rotate to allow the rolled paper product to be unwound.

Embodiment 7. The paper product dispenser of embodiment 6, wherein the first and second spindles lie in a same horizontal plane.

Embodiment 8. The paper product dispenser of any of the preceding embodiments, wherein the rolled product are hand towels.

Embodiment 9. A method for dispensing paper product comprising rotating a rolled product to feed a tail of the rolled product into a feed mechanism having a first side opening and a second side opening different from the first side opening, wherein the first side opening is configured to accept the tail of the rolled product when the rolled product has a first orientation and rotated in the first direction and the second side opening is configured to accept the tail of the product when the rolled product has a second orientation and is rotated in the second direction.

Embodiment 10. The method of embodiment 9, wherein a motor rotates the rolled product.

Embodiment 11. The method of any of embodiments 9 or 10, wherein the feed mechanism comprises a feed puller including a two opposing feed rollers configured to rotate to pull the tail through at least one of the first and second side openings, the method comprising rotating the two opposing feed rollers.

Embodiment 12. The method of embodiment 11, comprising rotating the two opposing feed rollers at a rate faster than the motor rotates the rolled product.

Embodiment 13. The method of embodiment 12, wherein the rate of the feed rollers is five percent faster than the rate of the rolled product.

Embodiment 14. The method of embodiment 12, wherein the rate of the feed rollers is ten percent faster than the rate of the rolled product.

Embodiment 15. The method of any of embodiments 9-14, comprising biasing the feed mechanism against a periphery of the rolled product as the rolled product's diameter decreases during depletion of the rolled product.

Embodiment 16. A paper product dispenser comprising a housing comprising dispenser throat, and a product holding area configured to hold a rolled product for dispensing through the dispenser throat; a first spindle arm in the product holding area and extending between the two sides, a second spindle arm in the product holding area, extending between the two sides and substantially parallel to the first spindle arm, wherein the first and second spindle arms are configured to hold the rolled product along a periphery of the rolled product to allow the rolled product to rotate to unwind; and a feed mechanism having a first side opening and a second side opening different from the first side opening, wherein both the first side opening and the second side opening are different from that dispenser throat, and wherein the first side opening is configured to accept the tail of the rolled product when the rolled product has a first orientation and is rotated in the first direction and the second side opening is configured to accept the tail of the product when the rolled product has a second orientation and is rotated in the second direction.

Embodiment 17. The paper product dispenser of embodiment 16, wherein the first and second spindles lie in a same horizontal plane.

Embodiment 18. The paper product dispenser of any of embodiments 16 or 17 comprising a motor to rotate at least one of the first spindle and the second spindle.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

This written description does not limit the invention to the precise terms set forth. Thus, while the invention has been described in detail with reference to the examples set forth above, those of ordinary skill in the art may effect alterations, modifications and variations to the examples without departing from the scope of the invention.

What is claimed is:

1. A paper product dispenser comprising:

a housing comprising a front, a back, two sides, a product holding area defined by the front, back and two sides, and a dispenser throat defining an opening through the housing;

a support device configured to support a rolled product in the product holding area, wherein the rolled product has a tail;

a motor operatively coupled to the rolled product and configured to rotate the rolled product in at least one of a first direction and a second direction; and a feed mechanism having a first side opening and a second side opening different from the first side opening, wherein both the first side opening and the second side opening are different from that dispenser throat, and wherein the first side opening is configured to accept the tail of the rolled product when the rolled product has a first orientation and is rotated in the first direction and the second side opening is configured to accept the tail of the product when the rolled product has a second orientation and is rotated in the second direction.

2. The paper product dispenser of claim 1, wherein the feed mechanism comprises a feed puller including two opposing feed rollers configured to rotate to pull the tail through at least one of the first and second side openings.

3. The paper product dispenser of claim 2, wherein the feed puller rotates at a first rate, the motor rotates the rolled product at a second rate, and the first rate is greater than the second rate.

4. The paper product dispenser of claim 1, wherein the feed mechanism includes a feed head slidably attached to a feed mechanism body.

5. The paper product dispenser of claim 4, wherein the feed head is configured to be biased against a periphery of the rolled product.

6. The paper product dispenser of claim 1, wherein the support device comprises:

a first spindle arm in the product holding area and extending between the two sides, a second spindle arm in the product holding area, extending between the two sides and substantially parallel to the first spindle arm, wherein the first and second spindle arms are configured to hold the rolled product along a periphery of the rolled paper product and rotate to allow the rolled paper product to be unwound.

7. The paper product dispenser of claim 6, wherein the first and second spindles lie in a same horizontal plane.

8. The paper product dispenser of claim 1, wherein the rolled product are hand towels.

9. A method for dispensing paper product comprising:

rotating a rolled product to feed a tail of the rolled product into a feed mechanism having a first side opening and a second side opening different from the first side opening, wherein the first side opening is configured to accept the tail of the rolled product when the rolled product has a first orientation and rotated in the first direction and the second side opening is configured to accept the tail of the product when the rolled product has a second orientation and is rotated in the second direction.

10. The method of claim 9, wherein a motor rotates the rolled product.

11. The method of claim 10, wherein the feed mechanism comprises a feed puller including a two opposing feed rollers configured to rotate to pull the tail through at least one of the first and second side openings, the method comprising rotating the two opposing feed rollers.

12. The method of claim 11, comprising rotating the two opposing feed rollers at a rate faster than the motor rotates the rolled product.

13. The method of claim 12, wherein the rate of the feed rollers is five percent faster than the rate of the rolled product.

14. The method of claim 12, wherein the rate of the feed rollers is ten percent faster than the rate of the rolled product.

15. The method of claim 9, comprising biasing the feed mechanism against a periphery of the rolled product as the rolled product's diameter decreases during depletion of the rolled product.

16. A paper product dispenser comprising:

a housing comprising dispenser throat, and a product holding area configured to hold a rolled product for dispensing through the dispenser throat;

a first spindle arm in the product holding area and extending between the two sides, a second spindle arm in the product holding area, extending between the two sides and substantially parallel to the first spindle arm, wherein the first and second spindle arms are configured to hold the rolled product along a periphery of the rolled product to allow the rolled product to rotate to unwind; and a feed mechanism having a first side opening and a second side opening different from the first side opening, wherein both the first side opening and the second side opening are different from that dispenser throat, and wherein the first side opening is configured to accept the tail of the rolled product when the rolled product has a first orientation and is rotated in the first direction and the second side opening is configured to accept the tail of the product when the rolled product has a second orientation and is rotated in the second direction.

17. The paper product dispenser of claim 16, wherein the first and second spindles lie in a same horizontal plane.

18. The paper product dispenser of claim 16 comprising a motor to rotate at least one of the first spindle and the second spindle.

* * * * *